United States Patent [19]

Shang

[11] Patent Number: 4,716,506

[45] Date of Patent: Dec. 29, 1987

[54] IRIS-PRODUCING LAMP DEVICE

[76] Inventor: Hui C. Shang, Room No. 330, Gate No. 2, Building No. 6 ZaoLinXiLi, XuanWu District, Beijing, China

[21] Appl. No.: 907,242

[22] Filed: Sep. 15, 1986

[30] Foreign Application Priority Data

Sep. 16, 1985 [CN] China ..... 85203803

[51] Int. Cl.[4] ..... F21V 9/00

[52] U.S. Cl. ..... 362/293; 350/162.18

[58] Field of Search ..... 350/162.18; 362/308, 362/351, 355, 806, 811, 293

[56] References Cited

U.S. PATENT DOCUMENTS

| | | | |
|---|---|---|---|
| 734,133 | 7/1903 | Porter | 350/162.18 |
| 1,954,199 | 4/1934 | Fraser et al. | 362/806 X |
| 2,196,214 | 4/1940 | Kantack | 362/806 X |
| 2,313,489 | 3/1943 | Latrobe | 350/162.18 X |
| 3,379,869 | 4/1968 | Dorman . | |
| 3,522,424 | 8/1970 | Fritsch . | |
| 4,525,772 | 6/1985 | Peck . | |

FOREIGN PATENT DOCUMENTS 58-19804 2/1983 Japan .

*Primary Examiner*—Stephen F. Husar
*Attorney, Agent, or Firm*—Armstrong, Nikaido, Marmelstein & Kubovcik

[57] ABSTRACT

An iris-producing lamp device comprises one or more non-monochromatic light sources with its socket or sockets mounted on bracket. A paraboloid mirror may be disposed behind each lamp socket and a light source in the focus of the paraboloid mirror and the lamp shade is made of a grating-film iris-producing glass with a non-monochromatic light source in it. Thus the lamp shade can reflect not only its original color but also the other colors when the lamp is shut-off while transmitting a variety of colorful patterns and projecting them to objects around the lamp device when the lamp is on.

7 Claims, 4 Drawing Figures

IRIS-PRODUCING LAMP DEVICE

The invention relates to an iris-producing lamp device. The iris-producing lamp device is a new kind of lamp device for decoration and illumination.

An object of the invention is to provide a lamp employing ordinary non-monochromatic light, sources which in cooperation with an iris-producing lamp shade make the shade to reflect its original color as well as other colors when the lamp is shut-off, and to transmit a variety of colored patterns and to project them to objects around the lamp without reducing the illumination intensity of a room when the lamp is on.

The known lamp devices and lamp shade may only transmit or reflect the same colored lights as those appeared in the devices and shade, which will lower the sense of beauty and limit their scope of application. The iris-producing lamp device according to the invention forcefully overcomes the deficiencies of the prior lamp devices, which can project irises on the objects around the lamp and change the transmitted or reflected colorful patterns depending on the types, numbers, shapes and positions of the light sources.

The lamp device according to the invention employs the grating-film iris-producing glass to form the lamp shade. The iris-producing glass is made by a sheet of crossed 2-dimensional grating-film or two sheets of 1-dimensional grating-film with one over the other in a crossed relation and in any case they should be supported fixedly. The iris-producing glass may be formed in a structure that the 1-dimensional or 2-dimensional grating film is held between two sheets of transparent material with the edges of the transparent material being bonded together chemically or fixed mechanically or bonded on one sheet of transparent material and also may be formed in a plate of glass or transparent plastics with their surfaces able to produce iris directly be constructed as a grating by means of replication, photography or the like. The iris-producing glass may have a variety of colors and the groove density of the grating will be 50 to 400 lines/mm, preferably 200 to 400 lines/mm. The light source may comprise one or more non-monochromatic light bulbs and in case of a plurality of lamps to be used, they should be arranged in different positions and different directions then the rays will be projected on the iris-producing lamp shade. The object of the invention can be achieved through the device described above.

The lamp device according to the invention may be employed for the purpose of advertisment display, decorating lamp or the like. Further, the lamp device is applicable in room illumination since its light intensity will not be reduced by producing the iris, In addition, it is simple to manufacture with low cost and may have wide applications.

The objects and advantages of the invention may become more apparent through the accompanying drawings and the following description.

Figure 1:
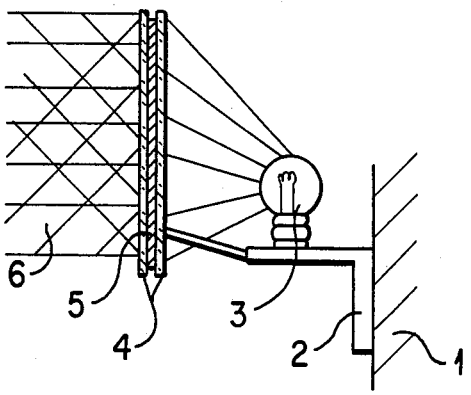
FIG. 1 is an illustration to show an embodiment according to the invention. It is a sectional view taken along the line A—A in FIG. 2.

In FIG. 1: 1, a support body; 2, a bracket; 3, a light source; 4, sheets of transparent material; 5, a grating-film; 6, transmitted rays.

Figure 2:
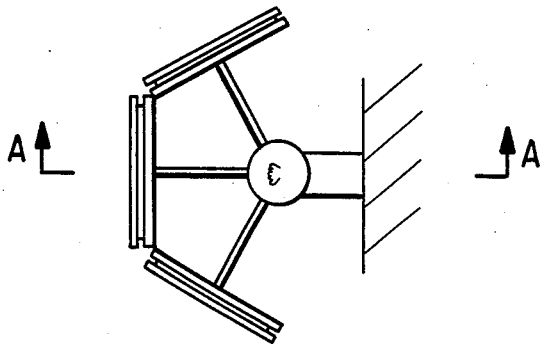
FIG. 2 is a plan view of a device showing in FIG. 1.

In the device shown in FIG. 1, the light source bracket 2 is fixed on the support body 1 and the sheets of transparent material used to clamp the grating-film 5 are connected fixedly with the bracket 2. Around the light source several plates of iris-producing glass may be disposed (see FIG. 2) then a color pattern will appear on the iris-producing glass when the light source 3 is on.

Figure 3:
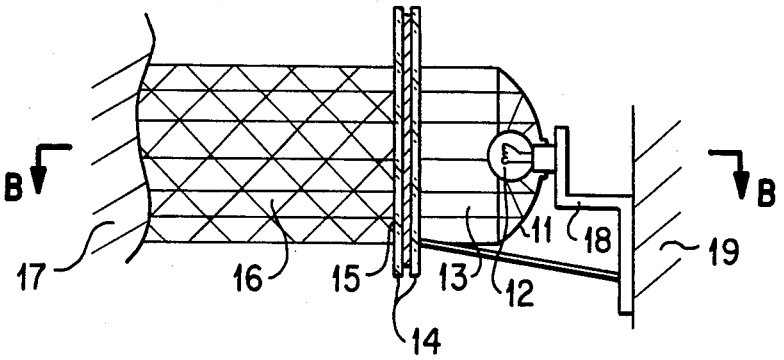
FIG. 3 shows a lamp device according to the invention with a paraboloid mirror. It is a sectional view taken along the line C—C in FIG. 4.
Figure 4:
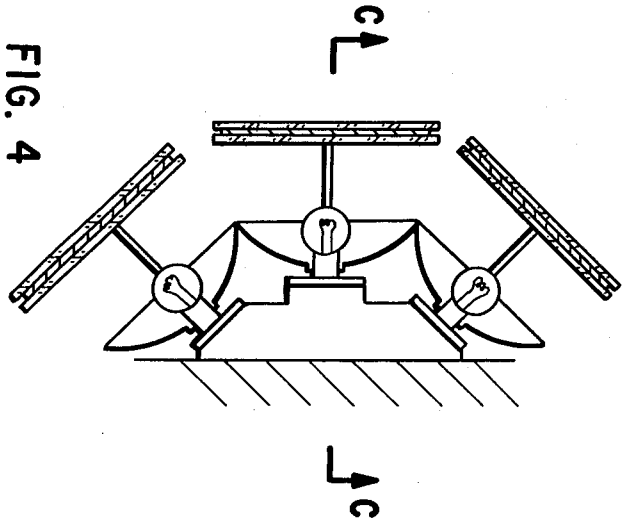
FIG. 4 is a sectional view of the device taken along the line B—B of FIG. 3.

FIG. 3 shows another embodiment of a device according to the invention wherein 19 is a support body, 18 is a bracket, 11 is a paraboloid mirror, 12 is a light source, 14 are sheets of transparent material, 15 is a grating-film, 16 is a color light-network and 17 are objects around the lamp. What is shown in FIG. 3 is a device having several light sources (see FIG. 4). The arrangement of the embodiment is as follows: the bracket 18 is mounted on the support body 19 and the sheets of transparent material 14 are connected fixedly with the bracket 18 with the light source 12 disposed on the focus of the paraboloid mirror 11. Once the light source 12 is on, the beam of parallel rays will project on the iris-producing glass and a color light-network 16 will be formed through the iris-producing glass, simultaneously, a color pattern will be projected on the objects 17 around the lamp.

The two kinds of arrangement mentioned above are embodiments of the invention, which never means a limitation to the construction of the invention. The invention allows a variety of modifications in the scope defined by the appended claims.

What I claimed is:

1. An iris-producing lamp device comprising one or more non-monochromatic light sources with its socket or their sockets on a bracket wherein a lamp shade also mounted on said bracket is made of a grating-film iris-producing glass, and wherein the grating-film iris-producing glass is made of a 2-dimensional grating-film or two 1-dimensional grating-films with one superimposed on the other crossedly and they are all clamped firmly between two sheets of transparent material or affixed on one sheet of the transparent material.

2. An iris-producing lamp device comprising one or more non-monochromatic light sources fixed in respective sockets which are mounted on brackets with a paraboloid mirror behind each lamp socket and a light source in the focus of the paraboloid mirror, wherein a lamp shade also mounted on said brackets is made of grating-film iris-producing glass, wherein the grating-film iris-producing glass is made of a 2-dimensional grating-film or two 1-dimensional grating-films with one superimposed on the other crossedly and they are all clamped firmly between two sheets of transparent material or affixed on one sheet of the transparent material.

3. The iris-producing lamp device according to either one of claims 1 or 2 wherein the grating-film iris-producing glass is made of a plate of glass or transparent plastic with their surfaces forming a grating by means of replication, photography or the like.

4. The iris-producing lamp device according to either one of claims 1 or 2 wherein the density of the grooves on the grating is 50 to 400 lines/mm.

5. The iris-producing lamp device according to either one of claims 1 or 2 wherein the density of the grooves on the grating is 200 to 400 lines/mm.

6. The iris-producing lamp device according to either one of claims 1 or 2 wherein the iris-producing glass is colored glass.

7. The iris-producing lamp device according to either one of claims 1 or 2 wherein the sheets of transparent materials are fixed mechanically or affixed chemically to the transparent material.

* * * * *